United States Patent [19]

Hovsepian

[11] 4,162,010

[45] Jul. 24, 1979

[54] COSMETIC DUSTING POWDER CONTAINER

[75] Inventor: Charles J. Hovsepian, West Caldwell, N.J.

[73] Assignee: Packaging Systems Corporation, Pearl River, N.Y.

[21] Appl. No.: 881,539

[22] Filed: Feb. 27, 1978

[51] Int. Cl.[2] ..... B65D 51/18; B65D 11/20

[52] U.S. Cl. ..... 206/823; 220/366; 132/83 R

[58] Field of Search ..... 132/83 R, 83 C, 83 D; 206/229, 823; 220/254, 256, 303, 306-307, 360, 366

[56] References Cited

U.S. PATENT DOCUMENTS

| | | | |
|---|---|---|---|
| 2,015,712 | 10/1935 | Chesler | 132/83 R |
| 2,217,307 | 10/1940 | Carter et al. | 206/823 X |
| 3,048,316 | 8/1962 | Roos et al. | 206/823 X |
| 3,613,938 | 10/1971 | Westcott | 220/366 X |
| 3,743,131 | 7/1973 | Croyle et al. | 220/307 X |
| 3,941,275 | 3/1976 | Simmons | 220/366 X |
| 4,058,214 | 11/1977 | Mancuso | 220/366 X |

FOREIGN PATENT DOCUMENTS

| | | | |
|---|---|---|---|
| 772884 | 8/1934 | France | 220/366 |

*Primary Examiner*—Davis T. Moorhead

*Attorney, Agent, or Firm*—Brooks, Haidt, Haffner & Delahunty

[57] ABSTRACT

A dish-shaped insert for a cylindrical container of cosmetic dusting powder or the like has a slightly upwardly and outwardly tapering peripheral wall terminating in a narrow flange. An integrally formed, protruding, circumferential rib extending around near the midpoint of the wall cooperates with one or more recesses at the upper edge of the container wall to permit escape of air as the insert is pressed into the container and then to seal the container when the rib passes the bottom of the wall recess, so that fine powder and product fragrance do not escape. The insert is injection molded or, preferably, thermoformed of thermoplastic sheet material and may bear one or more tabs to facilitate removal as well as indicia such as a trademark or name.

9 Claims, 7 Drawing Figures

Fig. 3.
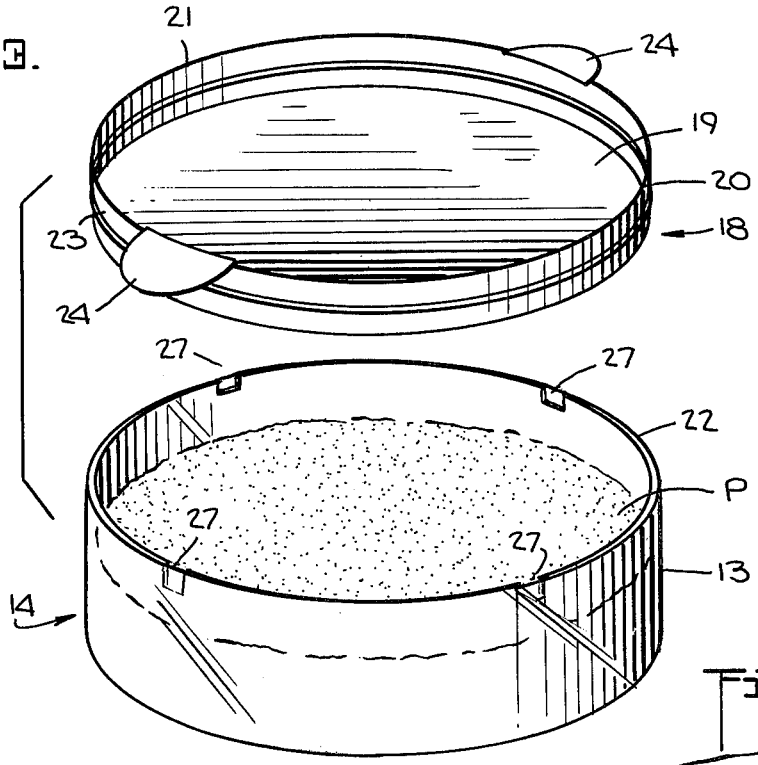
Fig. 7.
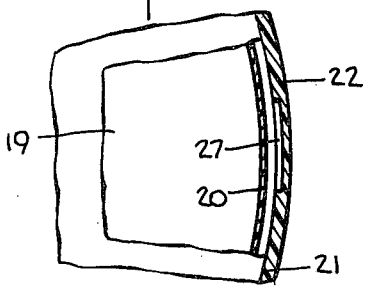
Fig. 4.
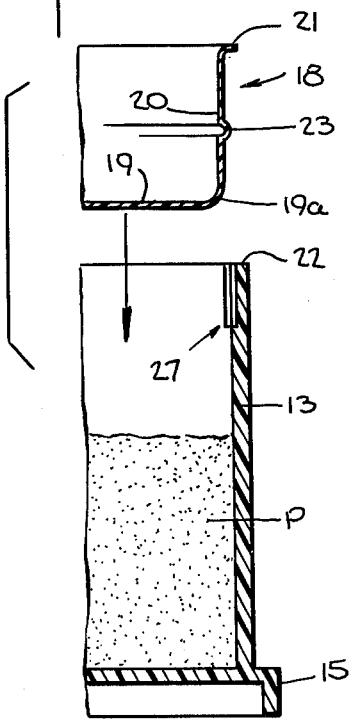
Fig. 5.
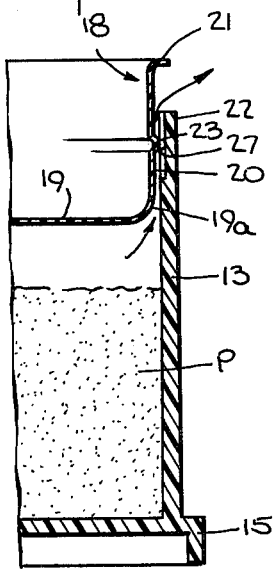
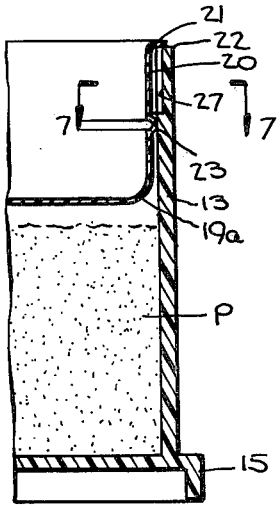
Fig. 6.

COSMETIC DUSTING POWDER CONTAINER

BACKGROUND OF THE INVENTION

1. Field of the Invention

The invention is in the packaging field, and more particularly, the invention relates to an arrangement for sealing a container of cosmetic dusting powder and to an insert used in such an arrangement.

2. Prior Art

Containers for cosmetic dusting powder are typically made of paperboard or injection molded plastic and are cylindrical in shape. After filling such a container with powder, some manufacturers insert a generally cylindrical paperboard closure member provided with a circumferential "bead" formed like a piece of textile fiber string to prevent the powder from spilling. Automatic equipment is widely used for fitting the paperboard inserts into place in filled containers.

Such prior art inserts are not completely satisfactory in preventing leakage of the very fine particles of dusting powder, and also fail to prevent escape of fragrance from the powder during periods of storage.

SUMMARY OF THE INVENTION

According to the present invention, a dusting powder container of the usual size and generally cylindrical shape is provided with a sealing insert formed of thermoplastic material which can be economically produced and fitted into the container by means of existing kinds of automatic equipment. The cylindrical wall of the container body has a plurality of recesses or areas of reduced wall thickness at the inner side of the mouth defined by the wall. These recesses allow escape of air which would otherwise be trapped upon insertion of the sealing insert, so there is no significant build up of pressure in the powder filled container body as the insert is pressed into place.

The insert itself, which is generally dish-shaped, has a substantially flat disc-like base portion, curved on a generous radius at the circular perimeter of the base into an upwardly and slightly outwardly extending annular wall which terminates in a narrow flange for seating against the lip of the container body's mouth. There is also an outwardly protruding circumferential rib integrally formed with, and extending around the insert wall at about the middle of the wall's height, which cooperates with the previously mentioned recesses in the container body wall. When inserted into the container body's mouth the circumferential rib does not seal off the escape of air until the insert is close to its final position, where the rib lies below the recesses and contacts the interior of the container body wall around its entire circumference. At this final, closed position, the terminal flange of the insert aligns the insert properly and further aids the rib in its sealing function.

The rounded area at the base of the insert makes placement in the container body easy, and the slight outward taper of the insert wall also guides the insert into position. The flange serves to position the insert at exactly the correct depth in the container body.

The upwardly dished out face of the insert can hold a powder applicator, such as a powder puff, and a cover or lid can be placed over the container body to enclose the body and powder applicator.

If desired, the insert may bear indicia such as a trademark or brand name, and preferably the insert is provided with one or more integrally formed tabs extending beyond the mouth of the container body for easy removal of the insert.

These and other features and advantages of the invention will be more fully understood from the following detailed description of the invention, especially when the same is read in view of the accompanying drawing figures.

BRIEF DESCRIPTION OF THE DRAWINGS

FIG. 3 illustrates an insert according to the invention removed from the container body also shown in the figure.

FIGS. 4, 5 and 6 are detail views in section illustrating the relative positions of parts as the insert is placed in the container body.

FIG. 7 is a sectional view in detail taken along line 7—7 of FIG. 6, looking in the direction of the arrows, and with part of the insert broken away to show internal structure.

DETAILED DESCRIPTION OF A PREFERRED EMBODIMENT

Figure 1:
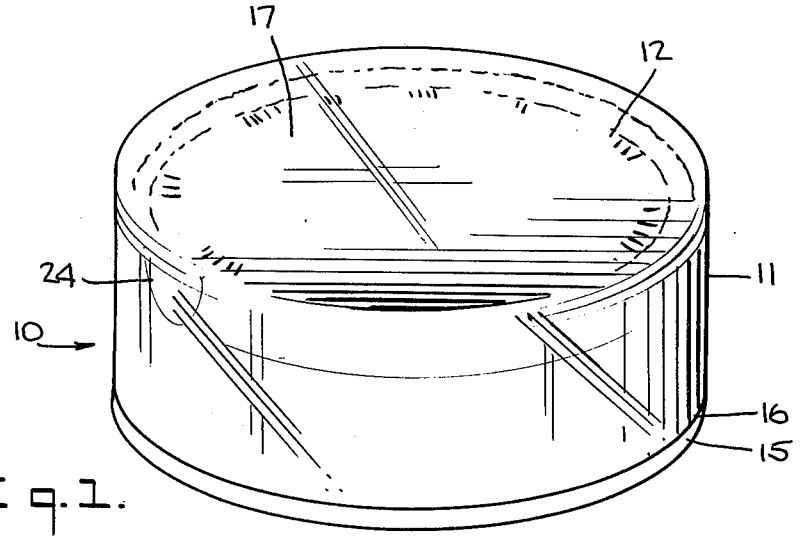
FIG. 1 is an overall view of a filled container according to the invention.
Figure 2:
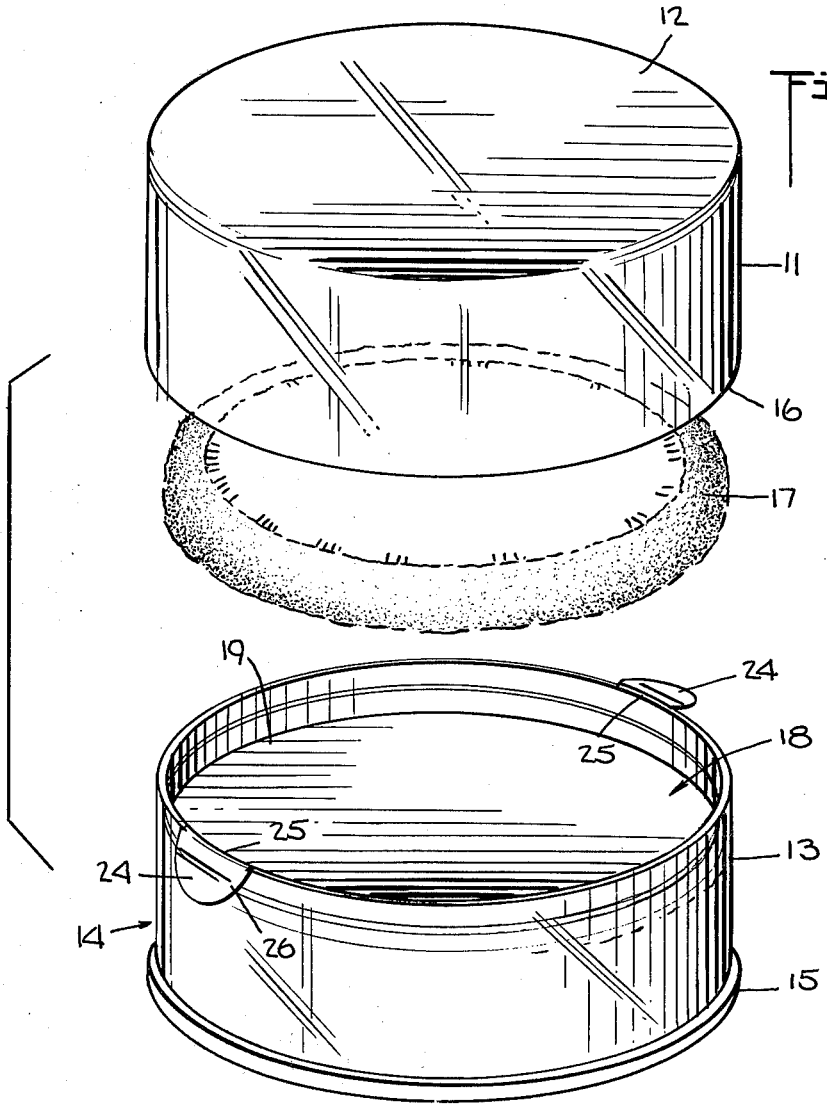
FIG. 2 shows the container of FIG. 1 with its outer cover removed, and with a powder puff removed.

FIGS. 1 and 2 of the drawings illustrate a cosmetic dusting powder container 10 according to the invention. The filled and closed container 10 of FIG. 1 is seen to be generally cylindrical, and might typically be about four to five inches in diameter and about two inches in height to hold about four or five ounces of finely divided dusting powder. The foregoing dimensions are merely illustrative of a fairly common container size, since the principles and structural features of the present invention can be applied and beneficially employed in a wide range of container sizes and shapes.

In the embodiment illustrated the container 10 has a substantially cylindrical cover 11 with a slightly dome shaped top portion 12, which can be of clear, transparent, hard plastic as illustrated, or of paperboard or other suitable material. The cover 11 is sized to fit slidably over the upstanding wall 13 of a container body 14, which can have an outwardly stepped base 15 abutting against the lower edge 16 of the cover when the container is closed as in FIG. 1. The container body 14 holds a quantity of powder P such as cosmetic dusting powder, best seen in FIGS. 3–6, which fills up about half of the space, more or less, within the container body 14 in the illustrated embodiment.

Cosmetic dusting powder chiefly consists of very finely ground talc, usually with a fragrance additive or additives, and possibly other ingredients. Although the container of the invention is discussed primarily in terms of its attractiveness for use with cosmetic dusting powder, it will be apparent that other kinds of powdered or granular material can be advantageously packaged according to the invention.

A powder applicator, shown in the form of a powder puff 17 slightly smaller in size than the diameter of the container body 14 is shown directly beneath the container cover 11 in FIG. 1. Such an applicator is customarily provided with cosmetic dusting powder.

Seated within the container body 14, and separating the powder applicator 17 from the powder P is an insert generally designated by the reference numeral 18. The insert 18 is formed of cosmetically acceptable synthetic plastic material.

As shown in FIG. 3, the insert 18 is generally dish-shaped with a substantially flat disc-like base portion 19 smoothly curving at its periphery 19*a* into an upstanding annular wall 20 which slants slightly outwardly and upwardly for ease of insertion into the container body 14. The curved perimeter at 19*a* assures fitting of the insert 18 within the container body wall 13 even when somewhat inaccurately centered, and the slight outward taper of the insert wall 20 guides the insert for accurate positioning. The insert wall 20 terminates in a narrow flange 21 for seating against the lip or rim 22 of the container body 14 as best seen in FIG. 6, so that the insert is neatly fitted and centered after placement in the filled container body 14. The flange 21 lies essentially parallel to the insert base 19 and can be quite narrow, so as not to extend beyond the outer side of the container body wall 13.

The diameter of the insert 18 is slightly smaller than the internal diameter of the container body 14 at the insert base 19, and widens slightly so that near the flange 21 the insert wall 20 fits snugly within the container body wall 13.

About halfway up the insert wall 20, between the base 19 and flange 21, there is an integrally formed, outwardly projecting, smoothly curved, circumferential rib for sealing engagement with the container body wall 13. In final position as shown in FIG. 6 the rib 23 is slightly compressed by the container body wall 13 to provide a leakproof seal, the the insert material is semi-rigid, but has sufficient flexibility, to allow easy insertion and removal from the container body 14.

The insert 18 is preferably formed with one or more integral tabs 24 for removal of the insert 18 by a user of the container contents. Two such tabs 24 at diametrically opposed positions, extending outward from the flange 21 are shown in the embodiment of the drawings. Referring to FIG. 1, it will be seen that the tabs 24 fold down outside the container body wall 13 when the cover 11 is placed over the filled container body 14. For this purpose there can be a weakened or scored area of the tabs 24 at or near the curved line at 25 when the tabs join the insert wall 20. The tabs 24 can also have an integrally formed rib 26 as shown in FIG. 2 to facilitate gripping by the fingers of the user. The rib 26 also helps to secure the container cover 11 in closed condition. The tabs 24 are shown as smoothly rounded in plan for convenience and safety.

The slight outward taper of the insert wall 20 also makes the inserts stackable or nestable for compact storage and shipment, and the tabs 24 do not interfere with such stacking.

Because of the sealing features of the insert 18, that is, the rib 23 and tapered wall 20, the insertion of the insert 18 into a snugly fitting cylindrical container would trap air below the insert. In accordance with the invention, provision is made for escape of air from beneath the insert 18 as it is fitted, either by automatic machinery or by hand, into the powder filled container body 14. For this purpose, the wall 13 of the container body 14 is formed with one or more recesses 27 extending downwardly from the lip or rim 22 at the inside of the wall 13 as best shown in the detail views of FIGS. 4–7.

Four such recesses 27 are shown at equally arcuately spaced locations around the container body, each recess 27 being a generally rectangular area of reduced thickness of the wall 13 extending from the upper edge of the wall 13 to a depth slightly smaller than the distance between the flange 21 of the insert 18 and the insert's circumferential rib 23. The manner of cooperation of the recesses 27 with the insert 18 is illustrated in FIGS. 4–7.

FIG. 4 shows the insert 18 ready for placement within the powder filled container body 14 by pressing the insert 18 directly downward in the direction of the arrow. It will be seen that the curved area 19*a* will first contact the wall lip 22 if the insert is not accurately aligned for insertion, guiding the insert 18 into correct alignment. At the condition shown in FIG. 5, the insert 18 has been pressed partially toward its final position of FIG. 6. The sectional view of the recess 27 in FIGS. 4–6 shows that the decreased wall thickness at the recess 27 keeps the insert wall 20 and projecting rib 23 out of sealing contact, allowing escape of air from the container space beneath the insert as shown by the arrow in FIG. 5. The escaping air travels past the rib 23 through the open space provided by the recess 27 as the insert is moving downward.

The relationship of the distance between the insert flange 21 and rib 23 and the vertical depth of the recess 27 is such that just before the flange 21 contacts the lip 22 of the container body 14, the circumferential rib 23 passes below the area of reduced wall thickness defined by the recess 27 so that the rib 23 is in sealing contact with the inner side of the container wall 13 throughout the entire circumference of the insert 18 and container body 13. This condition is illustrated by the relationship between the rib 23 and container body wall 13 shown in FIG. 6 where the insert 18 has reached its final sealing position. No powder or fragrance can escape through the recess 27 in the closed condition of FIG. 6, the avenue of escape through the recess 27 being blocked by the rib 23. It will be seen that in the closed condition of FIG. 6, the flange 21 is seated on the container wall lip 22.

As an illustrative example, the recess 27 can have a vertical depth of about ¼ inch when the distance between the narrow insert flange 21 and the circumferential rib is about 5/16 inch, allowing the rib 23 to move past the recess 27 before the insert's downward travel is checked by the seating of the flange 21 on the container lip 22. The reduction in wall thickness at the recess 27 is very small, just enough to allow air to escape, as seen by the relative dimensions of the several parts shown in the drawing wherein the thickness of plastic has been slightly exaggerated for clarity.

In some applications it might be desirable to reverse the cooperating parts, for example, by forming recesses in the insert 18 extending part of the wall height from the insert base to cooperate with an inwardly projecting internal circumferential rib formed in the container wall 13 to seal the container body only after the insert 18 has been almost fully inserted, but the preferred relationship of parts for most applications is the arrangement shown, for reasons including economy and simplicity of manufacture.

The insert 18 can be produced from clear, opaque or translucent sheet plastic material by suitable injection molding or, thermoforming processes, and the container body 13 can be made by thermoforming or injection molding. Preferably the container body 13 is hard and rigid while the insert 18 is relatively flexible.

The container body and/or the insert 18 can bear indicia such as decorations or a trademark or trade name. In one preferred embodiment such indicia are formed in the material of the insert 18 at the base area 19 while the insert itself is being shaped as by thermoforming.

Various modifications, substitutions of materials, and applications will suggest themselves to those skilled in the art and are considered to be within the spirit and scope of the invention. For example, instead of the cylindrical shape illustrated the container could be oval or some other shape, using an insert that is oval in plan.

What is claimed is:

1. A container of the type used for cosmetic dusting powder comprising a container body having an upstanding wall, and an insert for placement within said container body to prevent escape of the container contents, said container wall having at least one area of reduced wall thickness defining an inwardly opening recess at a lip of said wall providing a passage for the escape of air as said insert is positioned within said container body and an outwardly projecting rib extending substantially around the periphery of said insert for closing said at least one passage to seal said container when said insert is fully inserted.

2. The container of claim 1 wherein said insert is generally dish-shaped, with a generally flat base and an upstanding wall.

3. The container of claim 1 wherein said insert is generally dish-shaped with a generally flat base and an integrally formed wall extending upwardly and outwardly from said base, said wall terminating in a narrow peripheral flange.

4. The container of claim 1 wherein said insert has a generally flat base, and an upstanding peripheral wall terminating in a narrow flange for seating on the lip of said container body wall, and said outwardly projecting rib extends entirely around said insert wall for sealing contact with said wall of the container body, said rib being so positioned as to close said passage by sealing engagement with said container body wall below said recess when said insert is fully inserted.

5. In combination with a container body having an upstanding wall with at least one area of reduced wall thickness defining an inwardly opening recess at a lip of said wall, a sealing insert of flexible plastic material having a flat base and an insert wall with a projecting rib and a terminal flange, said rib extending substantially entirely around said insert wall spaced from said flange by a distance greater than the distance said recess extends from said lip.

6. The combination of claim 5 wherein said insert base is disc shaped and is joined to said insert wall by a smoothly curved area, and said wall extends outward from said base at a small angle.

7. The combination of claim 5 wherein said insert is formed in one piece of thin plastic material, and has at least one tab projecting from said insert wall for removal of said insert.

8. The combination of claim 5 wherein said insert base has a diameter substantially greater than the height of said insert wall, said projecting rib is located about at the middle of said insert wall, and said flange is substantially narrower than the height of said insert wall.

9. The combination of claim 5 wherein said insert wall between said flange and said rib and between said rib and said base is smooth and uninterrupted.

* * * * *